US011087716B2

(12) United States Patent
Tokuchi

(10) Patent No.: US 11,087,716 B2
(45) Date of Patent: Aug. 10, 2021

(54) CONTROL DEVICE AND NON-TRANSITORY COMPUTER READABLE MEDIUM

(71) Applicant: FUJIFILM BUSINESS INNOVATION CORP., Tokyo (JP)

(72) Inventor: Kengo Tokuchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/896,707

(22) Filed: Jun. 9, 2020

(65) Prior Publication Data

US 2021/0201848 A1 Jul. 1, 2021

(30) Foreign Application Priority Data

Dec. 27, 2019 (JP) ..... JP2019-239615

(51) Int. Cl.
*G09G 5/10* (2006.01)

(52) U.S. Cl.
CPC ..... *G09G 5/10* (2013.01); *G09G 2320/0626* (2013.01); *G09G 2320/08* (2013.01); *G09G 2320/10* (2013.01); *G09G 2354/00* (2013.01)

(58) Field of Classification Search
CPC ..... G09G 2320/0626; G09G 2320/064; G09G 2320/0261; G09G 2320/0646; G09G 2320/0653; G09G 2320/0233; G09G 2320/0633; G09G 2320/028; G09G 2320/0613; G09G 2354/00; G09G 5/10; G09G 5/003; G09G 3/3406; G09G 3/3225; G09G 3/3648; G09G 3/36; G09G 3/3413; G09G 3/34
See application file for complete search history.

(56) References Cited

U.S. PATENT DOCUMENTS

2005/0264702 A1* 12/2005 Yoshii ..... H04N 21/4314 348/687
2011/0135114 A1* 6/2011 Oba ..... H04N 21/42201 381/107
2012/0206340 A1* 8/2012 Mori ..... G09G 5/00 345/156
2012/0218179 A1* 8/2012 Oba ..... G06F 3/013 345/156
2013/0082991 A1* 4/2013 Lin ..... G09G 5/00 345/207
2014/0062328 A1* 3/2014 Toyooka ..... H05B 45/24 315/210
2014/0111500 A1* 4/2014 Kasuga ..... G09G 5/003 345/212
2014/0176469 A1* 6/2014 Lim ..... G06F 3/04847 345/173
2015/0213786 A1* 7/2015 Mamajiwala ..... G09G 5/00 345/428

(Continued)

FOREIGN PATENT DOCUMENTS

JP 2010-191288 A 9/2010
JP 2017-79001 A 4/2017

*Primary Examiner* — Dong Hui Liang
(74) *Attorney, Agent, or Firm* — Oliff PLC

(57) ABSTRACT

A control device includes a processor configured to grasp a status of a user around a display device and lower brightness of a display screen of the display device or reduce a change in brightness of the display screen per unit time in a case where the grasped status of the user is a specific status.

17 Claims, 11 Drawing Sheets

(56) References Cited

U.S. PATENT DOCUMENTS

| | | | | |
|---|---|---|---|---|
| 2015/0359070 | A1* | 12/2015 | Mead | H05B 47/16 315/154 |
| 2016/0048202 | A1* | 2/2016 | Hwang | G06K 9/00248 345/156 |
| 2016/0205391 | A1* | 7/2016 | Kim | G09G 3/3225 348/51 |
| 2016/0286626 | A1* | 9/2016 | Kano | G09G 3/3426 |
| 2017/0192486 | A1* | 7/2017 | Park | G06F 1/3231 |
| 2017/0272815 | A1* | 9/2017 | Yan | H04N 21/441 |
| 2020/0128177 | A1* | 4/2020 | Gotou | G06F 3/14 |

* cited by examiner

FIG. 7

| SPACE 2A | SPACE 2B | SPACE 2C |
|---|---|---|
| 10:00 TO 11:00 ON APRIL 5 | 10:00 TO 11:00 ON APRIL 5 · PERSON F | 10:00 TO 11:00 ON APRIL 5 |
| 11:00 TO 12:00 ON APRIL 5 | 11:00 TO 12:00 ON APRIL 5 | 11:00 TO 12:00 ON APRIL 5 |
| 12:00 TO 13:00 | 12:00 TO 13:00 | 12:00 TO 13:00 |

FIG. 8

| USER A | USER B | USER C |
| --- | --- | --- |
| NAME: ..... | NAME: ..... | NAME: ..... |
| BIRTH DATE: ..... | BIRTH DATE: ..... | BIRTH DATE: ..... |
| AGE: ..... | AGE: ..... | AGE: ..... |
| GENDER: ..... | GENDER: ..... | GENDER: ..... |
| NATIONALITY: ..... | NATIONALITY: ..... | NATIONALITY: ..... |
| ADDRESS: ..... | ADDRESS: ..... | ADDRESS: ..... |
| TELEPHONE NUMBER: ..... | TELEPHONE NUMBER: ..... | TELEPHONE NUMBER: ..... |
| PASSWORD: ..... | PASSWORD: ..... | PASSWORD: ..... |
| USER ID: ..... | USER ID: ..... | USER ID: ..... |

FIG. 9

| SPACE 2A | SPACE 2B | SPACE 2C |
| --- | --- | --- |
| ADDRESS: ..... | ADDRESS: ..... | ADDRESS: ..... |
| POSITION COORDINATE: ..... | POSITION COORDINATE: ..... | POSITION COORDINATE: ..... |
| NEARBY STATION: ..... | NEARBY STATION: ..... | NEARBY STATION: ..... |
| CAPACITY: ..... | CAPACITY: ..... | CAPACITY: ..... |
| SOUND INSULATION PERFORMANCE: ..... | SOUND INSULATION PERFORMANCE: ..... | SOUND INSULATION PERFORMANCE: ..... |

CONTROL DEVICE AND NON-TRANSITORY COMPUTER READABLE MEDIUM

CROSS-REFERENCE TO RELATED APPLICATIONS

This application is based on and claims priority under 35 USC 119 from Japanese Patent Application No. 2019-239615 filed Dec. 27, 2019.

BACKGROUND

(i) Technical Field

The present disclosure relates to a control device and a non-transitory computer readable medium.

(ii) Related Art

Japanese Unexamined Patent Application Publication No. 2017-79001 discloses processing for controlling luminance of a screen of a display so that the luminance is not lowered while proximity of an object is being detected by a proximity detector.

Japanese Unexamined Patent Application Publication No. 2010-191288 discloses a display control device that controls display of a liquid crystal panel provided with a touch panel, wherein the liquid crystal panel is provided with a photosensor that detects approach of a user's hand.

SUMMARY

A display device can provide a user with information. However, display on the display device may sometimes affect a user, for example, may undesirably hinder user's work.

Aspects of non-limiting embodiments of the present disclosure relate to reducing influence of display on a display device on a user as compared with a case where brightness of display on a display device is not changed in accordance with a user's status.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a control device comprising a processor configured to grasp a status of a user around a display device and lower brightness of a display screen of the display device or reduce a change in brightness of the display screen per unit time in a case where the grasped status of the user is a specific status.

BRIEF DESCRIPTION OF THE DRAWINGS

An exemplary embodiment of the present disclosure will be described in detail based on the following figures, wherein:

FIG. 7 illustrates a reservation list stored in a hard disk drive of the space management server;

FIG. 8 illustrates a user list stored in a hard disk drive of the space management server;

FIG. 9 illustrates a space list;

DETAILED DESCRIPTION

An exemplary embodiment of the present disclosure is described below with reference to the drawings.

Figure 1:
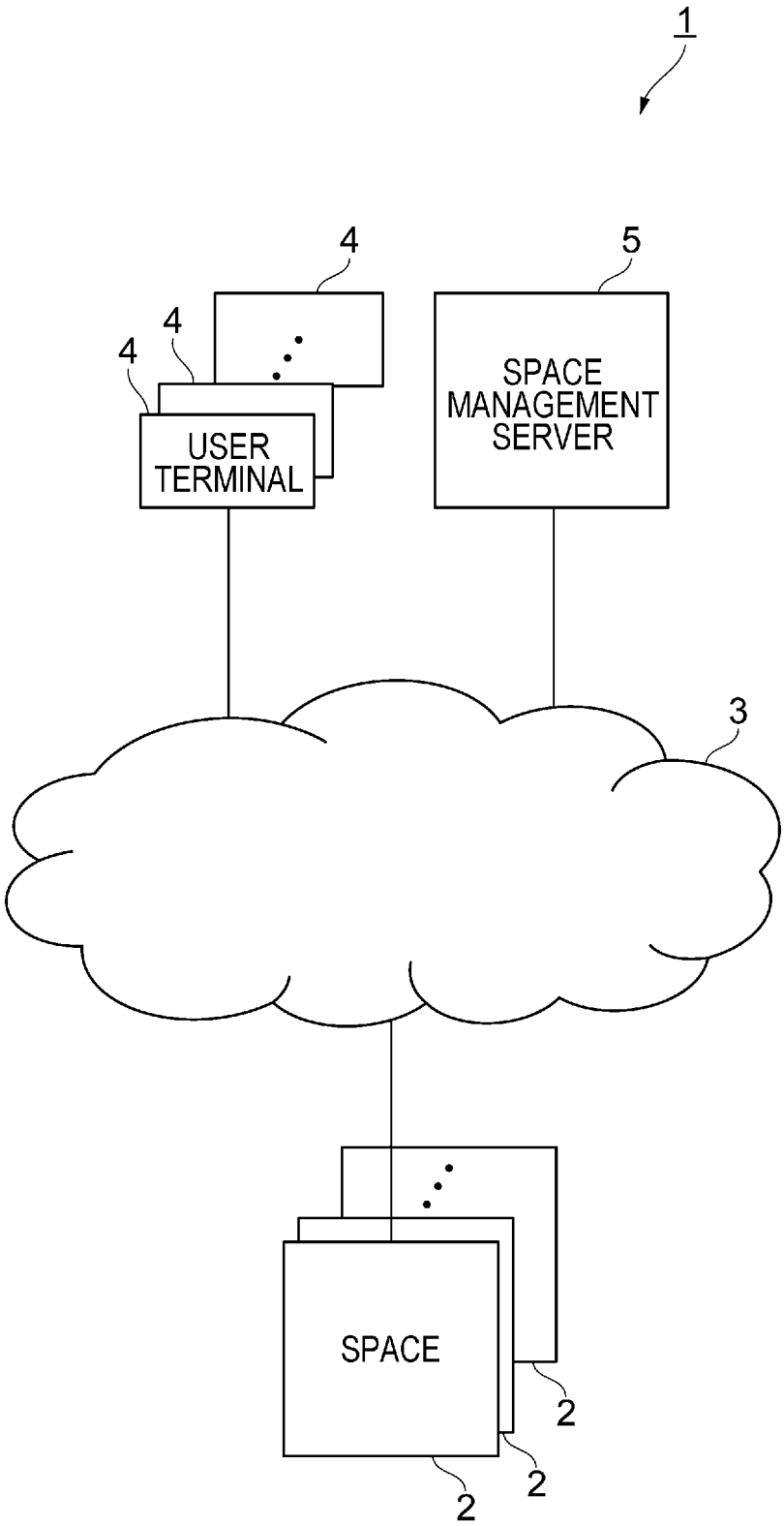
FIG. 1 schematically illustrates an overall configuration of an information processing system.

FIG. 1 schematically illustrates an overall configuration of an information processing system 1 according to the present exemplary embodiment.

In the present exemplary embodiment, plural spaces 2, which are an example of places reserved and used by a user, are provided.

Examples of the spaces 2 include booths, guest rooms of a facility such as an accommodation facility, and conference rooms of a company. These are examples of the spaces 2 that are partitioned from surroundings by a wall, a partition, or the like. Furthermore, examples of the spaces 2 according to the present exemplary embodiment include tables and seats on which service is offered at a restaurant, a barber shop, or the like. These are examples of the spaces 2 opened to surroundings.

The information processing system 1 illustrated in FIG. 1 includes various terminals connected to a cloud network 3.

In FIG. 1, user terminals 4 operated by users and a space management server 5 that manages the spaces 2 are illustrated as examples of the terminals connected to the cloud network 3. Furthermore, the spaces 2 are connected to the cloud network 3. More specifically, various apparatuses are provided in the spaces 2, and these apparatuses are connected to the cloud network 3.

The spaces 2 may be managed by a single business operator or plural business operators. For example, different business operators may be in charge of management of reservations, management of entry into and exit from rooms, statuses of usage of rooms, and the like, management of charging of usage fees on users, and management of members registered as users.

As described above, the spaces 2 managed as targets reserved by users need not be spaces of the same type. For example, some of the spaces 2 may be booths, and some of the spaces 2 may be seats or tables of a restaurant or the like.

Furthermore, management of a single purpose or function may be provided by plural business operators in cooperation.

In the present exemplary embodiment, doors of the spaces 2 are equipped with an electronic lock so that the spaces 2 can be locked. In the present exemplary embodiment, persons who have an authority to unlock the spaces 2 can access the spaces 2.

To unlock a space 2, a person who tries to unlock the space 2 gives an unlocking instruction by operating his or her user terminal 4. This instruction is sent to the space management server 5, and the space management server 5 receives the instruction. Then, the space management server 5 gives an instruction to unlock the space 2 for which the unlocking instruction is aimed. This causes the electronic lock of the space 2 to operate, thereby unlocking the space 2.

In the present exemplary embodiment, it is assumed that the user terminals 4 are smartphones, which are portable. Note, however, that the portable user terminals 4 may be wearable terminals, notebook computers, or gaming terminals.

The space management server 5 manages various kinds of information related to the spaces 2. For example, the space management server 5 manages information for specifying users, information for specifying the spaces 2 reserved by users, start dates and times of reservations, and end dates and times of reservations.

Examples of the information for specifying users include users' names, genders, ages, accounts, user IDs, passwords, and information for management given to the individuals. Examples of the information for specifying the spaces 2 used by users include information for specifying places such as addresses or locations and names and numbers for management.

The space management server 5 may manage reservations of articles and services associated with the spaces 2. For example, the space management server 5 may manage articles and services that are permitted to be borrowed or used and consumed or consumable articles and services.

Furthermore, the space management server 5 manages various kinds of information related to usage of the spaces 2. For example, the space management server 5 manages information on statuses of usage of the spaces 2 and information on users of the spaces 2.

Furthermore, the space management server 5 unlocks and locks the spaces 2.

The space management server 5 also functions as a control apparatus and controls the various apparatuses provided in the spaces 2. Note that a control apparatus may be provided in each of the spaces 2, and various apparatuses provided in each of the spaces 2 may be controlled by the control apparatus provided in the space 2.

Appearance Configuration of Spaces 2

Figure 2:
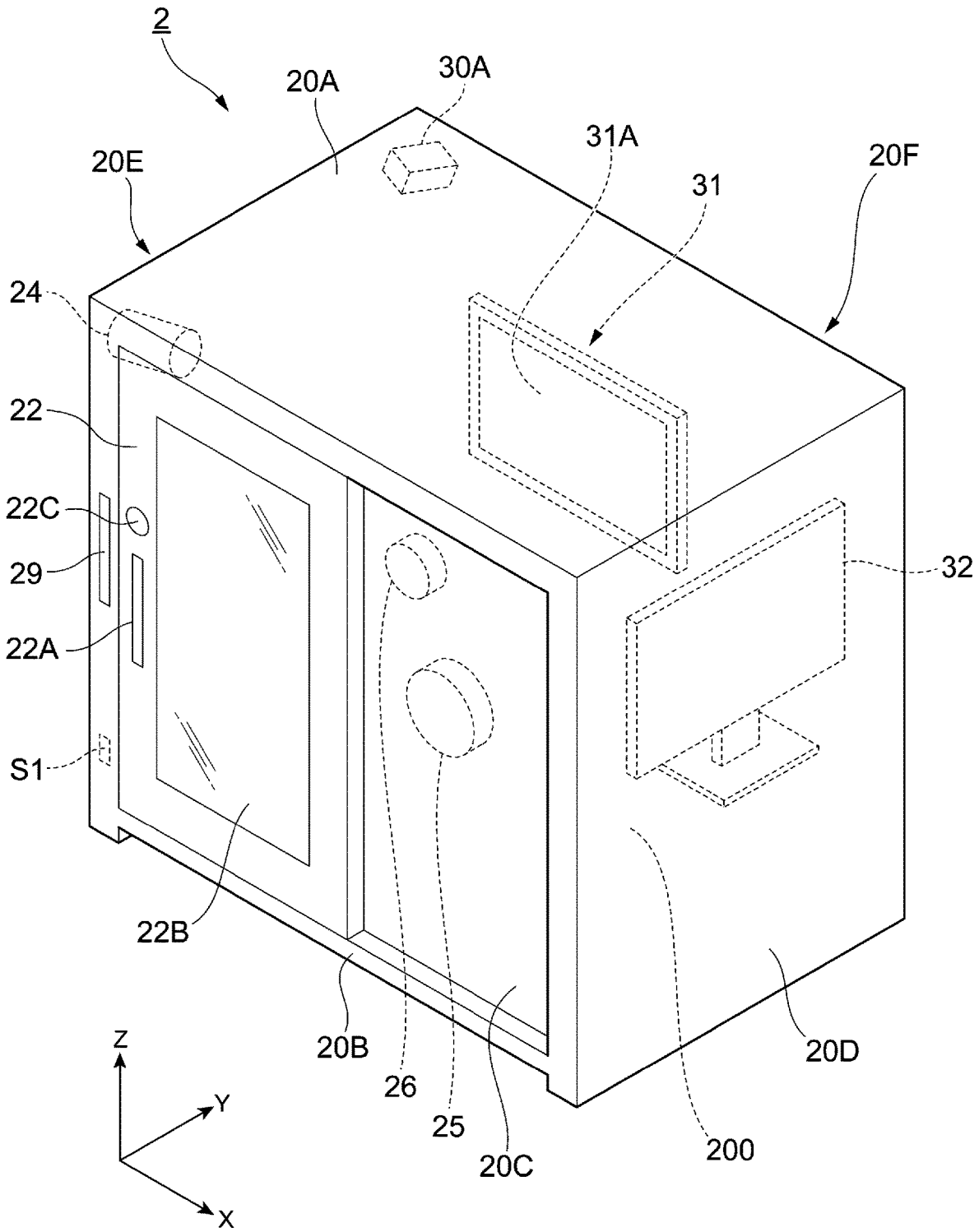
FIG. 2 is a view for explaining an example of a booth-type space.

FIG. 2 is a view for explaining an example of a booth-type space 2.

The booth-type space 2 illustrated in FIG. 2 is placed at an indoor or outdoor place such as a train station, an airport, an office building, a commercial facility such as a restaurant or a department store, a bank, a library, an art museum, a museum, a public institution or facility, an accessway, or a park.

The booth-type space 2 illustrated in FIG. 2 is a closed-type booth provided with a ceiling. Note that the closed type does not mean "completely closed" and just needs to have practical sound insulation.

A body of the space 2 may be provided with an opening or a gap such as a ventilation hole or a small window. The window may be openable and closable.

The body of the space 2 illustrated in FIG. 2 includes a ceiling 20A, a floor 20B, a wall 20C equipped with a door 22, which is openable and closable, two walls 20D and 20E located on both sides of the wall 20C, and a wall 20F that faces the door 22.

In the present exemplary embodiment, the space 2 is surrounded by the wall 20C, the door 22, the wall 20D, the wall 20E, and the wall 20F, and a room 200 is created inside these four walls and the door 22 by these four walls and the door 22.

In the present exemplary embodiment, it is assumed that the door 22 is a sliding door that is movable along the wall 20C. Although the door 22 is a single sliding door that slides in one direction in FIG. 2, the door 22 may be a sliding doorset including two or more members sliding on respective lanes or a sliding doorset including two members sliding on a single lane.

In the present exemplary embodiment, the door 22 is provided with a handle 22A used by a user to open or close the door 22. Furthermore, the door 22 is provided with an electronic lock 22C that can lock and unlock the door 22. Furthermore, in the present exemplary embodiment, the door 22 is provided with an opening closing sensor S1 that detects opening and closing of the door 22.

The number of persons which the space 2 accommodates is roughly determined by a volume of the space 2. In the present exemplary embodiment, it is assumed that the space 2 is a cabin-type space that is basically used by a single person.

Note, however, that the space 2 may be a large room that accommodates a large number of persons. The large room may be a single independent room or may be a room created by connecting plural rooms 2 by removing one of or both of the walls 20D and 20E of the spaces 2.

Note that the cabin type does not mean that only one person can use the space and means that a small number of persons (e.g., two or three persons) can use the space.

A shape and a structure of the body, equipment, and performance of the space 2 are not limited in particular. For example, the ceiling 20A may be removed.

In the present exemplary embodiment, a single desk (not illustrated in FIG. 1) and a single chair are placed in the body. Furthermore, prepared equipment and apparatuses and reserved equipment and apparatuses are placed in the body.

As the prepared equipment, a first monitor 31 and a second monitor 32, which are display devices that display an image, are provided.

The first monitor 31 is attached to the wall 20F. The first monitor 31 is a monitor used as digital signage and displays mainly an image for advertisement.

The second monitor 32 is on the desk (not illustrated in FIG. 1). The second monitor 32 is a monitor to which a user's personal computer (PC) is connected. In particular, the second monitor 32 is a monitor used to enlarge an image displayed on a screen of the user's PC.

In the present exemplary embodiment, an image displayed on a screen of a PC is displayed on the monitor 32 by connecting the PC to the monitor 32 by using a cable (not illustrated).

In the present exemplary embodiment, a speaker 30A, which is a sound output device for outputting sound, is provided as prepared equipment. Alternatively, sound may be output from a speaker of the first monitor 31 or the second monitor 32 without providing the speaker 30A.

Furthermore, a photographing apparatus 24 (e.g., a camera) that photographs an inside of the body and a human sensor 25 that detects a user in the body are provided in the body. Furthermore, a temperature sensor 26 that detects a temperature in the space 2 is provided in the body.

Furthermore, an information acquisition device 29 for acquiring individual information of a user of the space 2 may be provided on an outer face of the body.

The information acquisition device 29 is, for example, a reader that reads an ID card held by a user. Alternatively, the information acquisition device 29 may be a reader that reads a fingerprint, a pattern of veins, and the like of a user.

Figure 3:
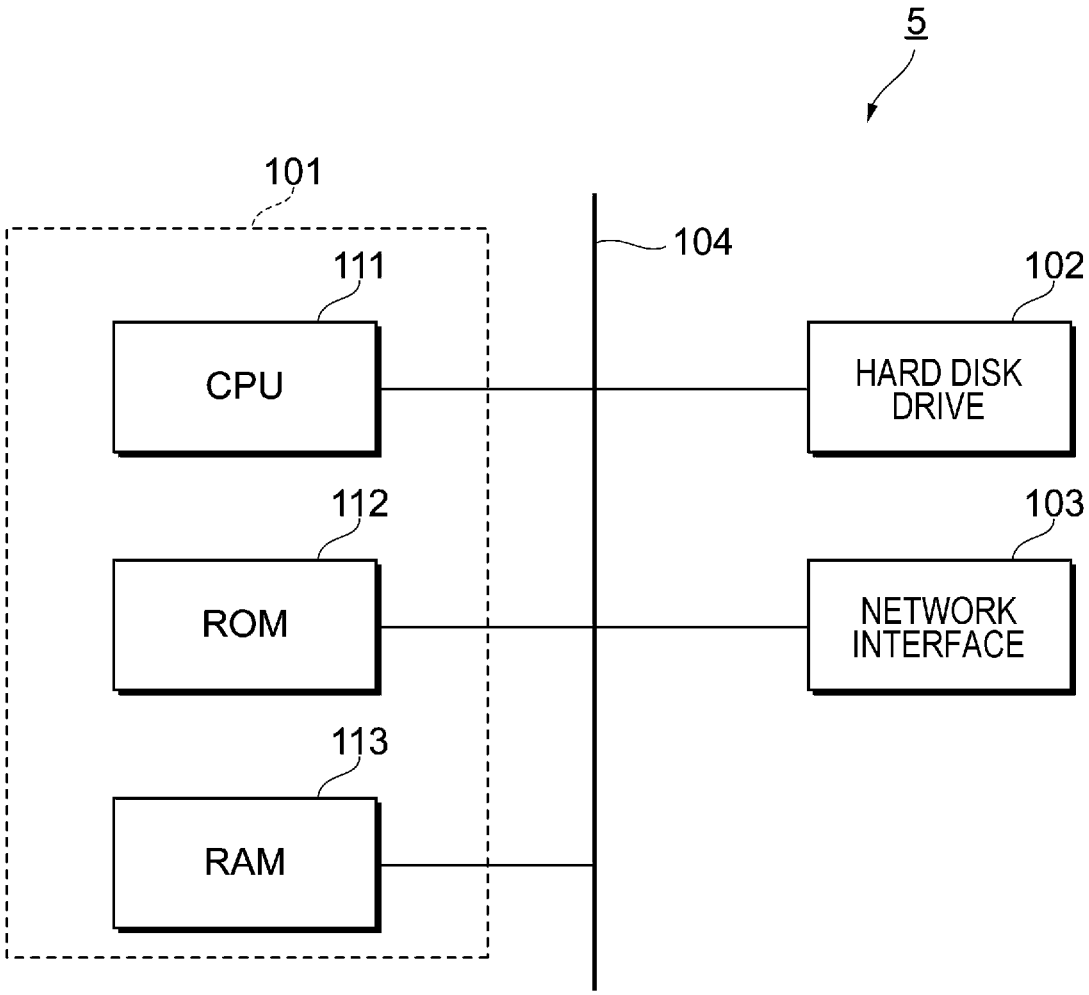
FIG. 3 is a view for explaining an example of a hardware configuration of a space management server.

FIG. 3 is a view for explaining an example of a hardware configuration of the space management server 5.

The space management server 5 has a control unit 101 that controls operation of the whole server, a hard disk drive 102 in which data such as management data is stored, and a network interface 103 that achieves communication through a local area network (LAN) cable or the like.

The control unit 101 has a central processing unit (CPU) 111, which is an example of a processor, a read only memory (ROM) 112 in which basic software, a basic input output system (BIOS), and the like are stored, and a random access memory (RAM) 113 used as a work area.

The CPU 111 may be a multi-core CPU. The ROM 112 may be a rewritable non-volatile semiconductor memory. The control unit 101 is a computer.

The hard disk drive 102 is a device that writes and reads data into and from a non-volatile storage medium having a disc-shaped substrate coated with a magnetic substance. Note, however, that the non-volatile storage medium may be a semiconductor memory or a magnetic tape.

In addition, the space management server 5 includes an input device such as a keyboard or a mouse and a display device such as a liquid crystal display device as needed.

The control unit 101, the hard disk drive 102, and the network interface 103 are connected through a bus 104 or a signal line (not illustrated).

A program executed by the CPU 111 may be offered to the space management server 5 while being stored in a computer-readable recording medium such as a magnetic recording medium (e.g., a magnetic tape, a magnetic disc), an optical recording medium (e.g., an optical disc), a magnetooptical recording medium, or a semiconductor memory. Alternatively, a program executed by the CPU 111 may be offered to the space management server 5 by using means of communication such as the Internet.

Figure 4:
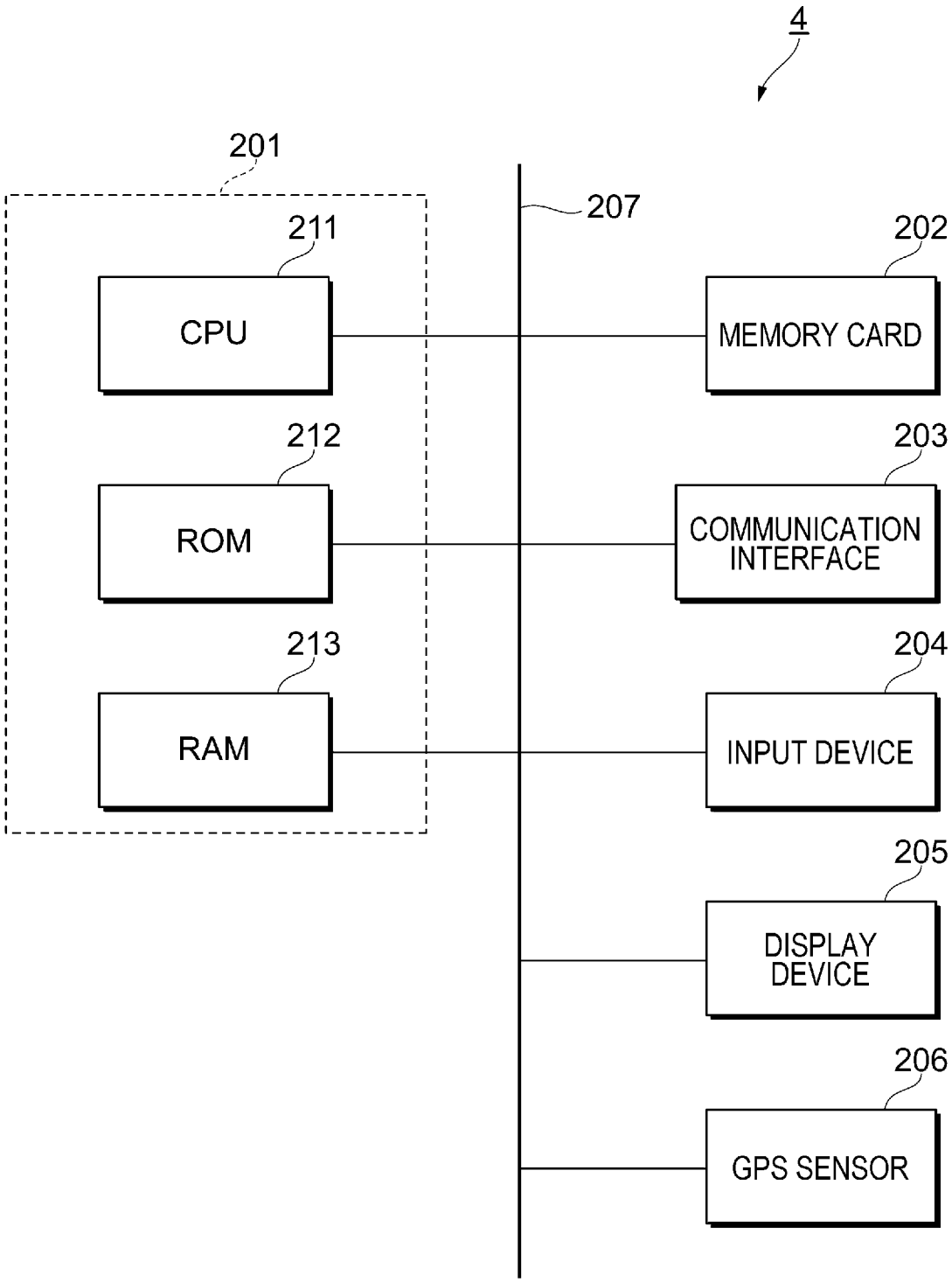
FIG. 4 is a diagram illustrating an example of a hardware configuration of a user terminal.

FIG. 4 is a diagram illustrating an example of a hardware configuration of the user terminal 4. FIG. 4 illustrates a case where the user terminal 4 is a smartphone.

The user terminal 4 has a control unit 201 that controls operation of the whole device, a memory card 202 in which various kinds of data are stored, various communication interfaces 203 that are compliant with a wireless communication standard, an input device 204 such as a touch sensor, a display device 205 such as a liquid crystal display device or an electro luminescence display device, and a global positioning system (GPS) sensor 206.

The control unit 201 has a CPU 211, a ROM 212 in which firmware, BIOS, and the like are stored, and a RAM 213 used as a work area. The CPU 211 may be a multi-core CPU. The ROM 212 may be a rewritable non-volatile semiconductor memory.

The communication interfaces 203 is, for example, an interface used for connection with a mobile communication system and an interface used for connection with a wireless LAN.

The GPS sensor 206 is a sensor that measures a position of the user terminal 4 on the basis of a radio wave received from a GPS satellite. Information on latitude, longitude, and altitude supplied from the GPS sensor 206 gives a current position of the user terminal 4. Note that the GPS sensor 206 may support an indoor position measurement system.

Figure 5:
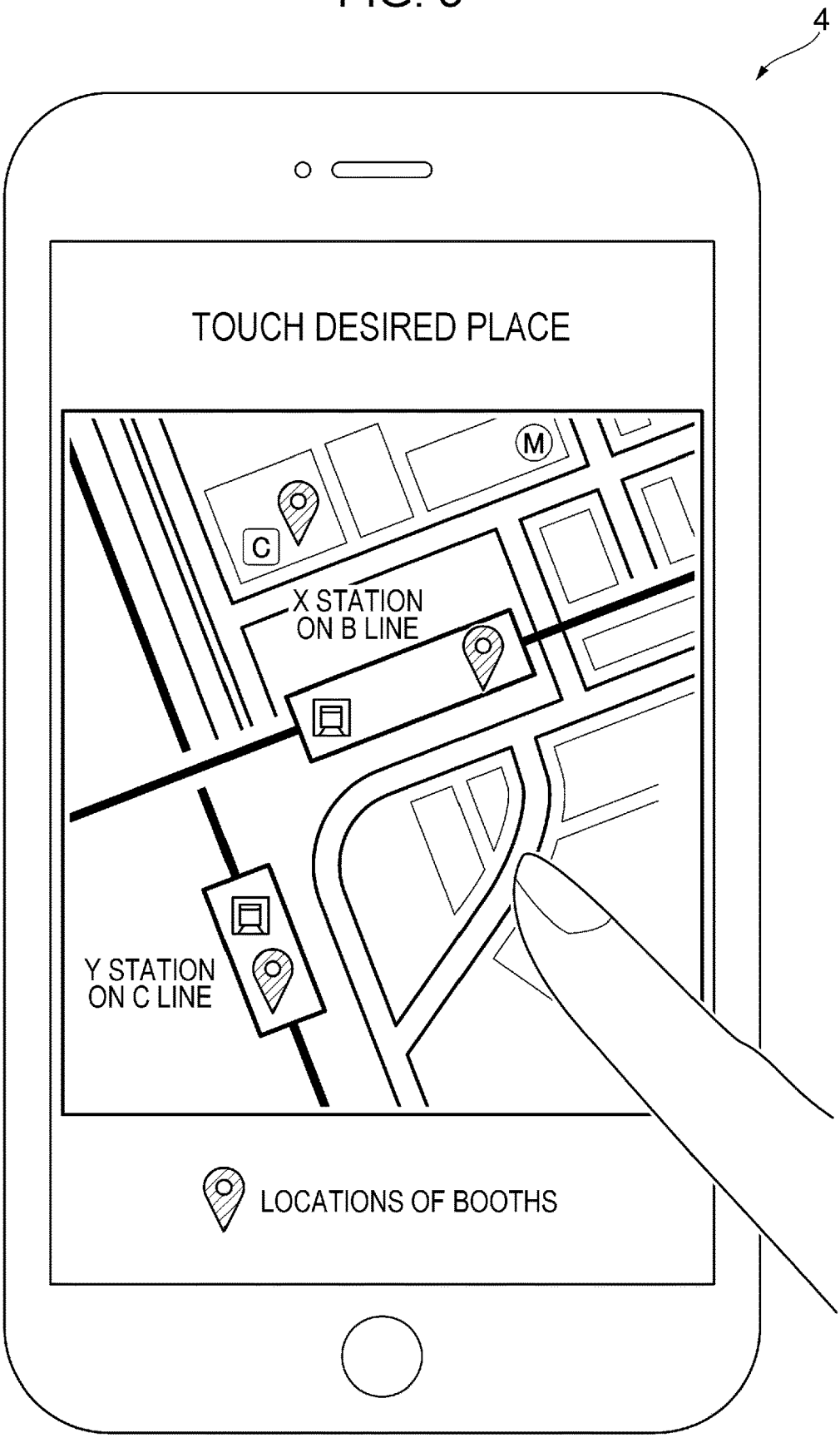
FIG. 5 illustrates an example of a display screen displayed on a user terminal of a person who requests to reserve a space.

FIG. 5 illustrates an example of a display screen displayed on the user terminal 4 of a person who requests to reserve a space 2.

On the display screen illustrated in FIG. 5, a map is displayed, and plural locations of the spaces 2, which are examples of places which a person requests to reserve, are displayed on the map.

In the present exemplary embodiment, a person who wants to reserve a space 2 first selects a location from among the plural locations of the spaces 2 displayed on the map.

Note that the way in which the plural locations of the spaces 2 are displayed is not limited to this. For example, the plural locations of the spaces 2 may be displayed in a list form, and the person may select a location from the list.

Figure 6:
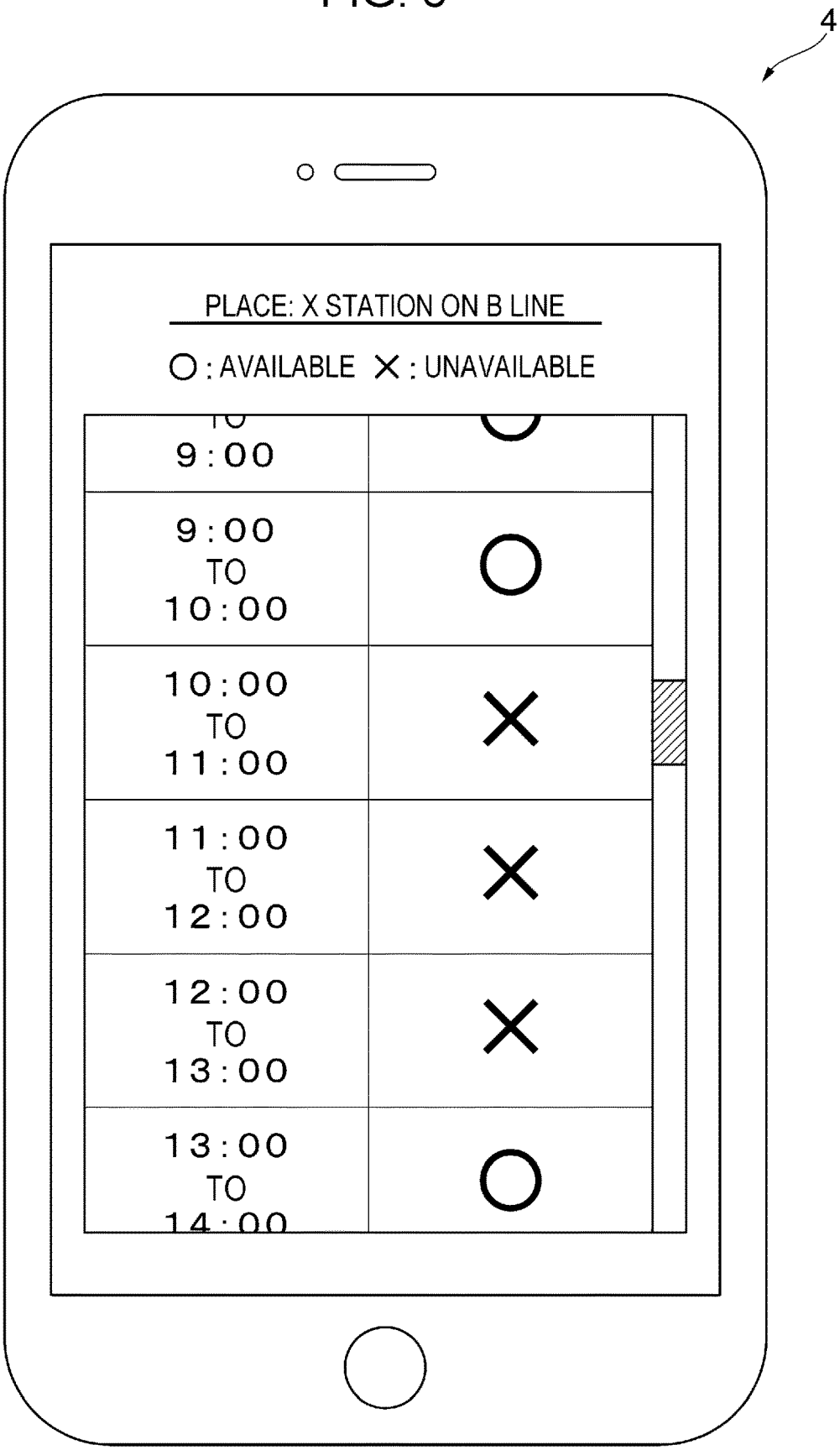
FIG. 6 illustrates another example of the display screen displayed on the user terminal.

When the person selects a location, availability of the space 2 at the selected location is displayed as illustrated in FIG. 6, which illustrates another example of a display screen displayed on the user terminal 4. In FIG. 6, time windows for which the space 2 has already been reserved and time windows for which the space 2 is still available are distinguishable.

The person designates a time window for which the person wants to reserve the space 2 on the display screen. Then, the person presses "Reserve" button (not illustrated). The length, start time, and end time of the time window may be freely set by the person.

This causes the space management server 5 to reserve the space 2 for the time window.

More specifically, the space management server 5 receives information on the location of the space 2 and the time window and registers the information on the location of the space 2 and the time window in the hard disk drive 102.

Then, a confirmation of the reservation is sent to the user terminal 4, and thus the person is informed that the reservation has been confirmed.

FIG. 7 illustrates a reservation list stored in the hard disk drive 102 of the space management server 5.

In the present exemplary embodiment, when a reservation of a space 2 made by a user is confirmed, the user is added as a reservation holder to the reservation list as illustrated in FIG. 7. More specifically, a reservation holder who made a reservation is registered in a field corresponding to a space 2 and a time window reserved by the reservation holder in the reservation list.

In the example illustrated in FIG. 7, a person F has reserved a space 2B for a time window 10:00 to 11:00 on April 5.

FIG. 8 illustrates a user list stored in the hard disk drive 102 of the space management server 5.

In the present exemplary embodiment, users of the spaces 2 need to complete user registration in advance. In the present exemplary embodiment, the users who try to register themselves as users enter information such as their names, birth dates, ages, genders, addresses, telephone numbers, and passwords, for example, on their user terminals 4.

In the present exemplary embodiment, these pieces of information are registered in the user list.

In the user list, information such as a name, a birth date, an age, a gender, an address, and a telephone number is registered in association with each user, as illustrated in FIG. 8.

In the user list, passwords set by the users and user IDs allocated to the users are also registered in association with the respective users.

In the present exemplary embodiment, upon receipt of an instruction to unlock a space 2 from a user terminal 4, the space management server 5 compares a user who gave the instruction to unlock the space 2 with users registered in the reservation list (see FIG. 7), and, if the user who gave the instruction to unlock the space 2 is registered in the reservation list, unlocks the space 2.

More specifically, in the present exemplary embodiment, when a reservation holder tries to unlock a space 2, the reservation holder enters an ID and a password on his or her user terminal 4. Through this authentication process, the operator who is operating the user terminal 4 is identified.

Then, in the present exemplary embodiment, when an instruction to unlock the space 2 is received from the user terminal 4 on which the operator has been authenticated, it is determined whether or not the operator who gave the instruction to unlock the space 2 is registered in the reservation list. In a case where the operator who gave the instruction to unlock the space 2 is registered in the reservation list, the space management server 5 unlocks the space 2.

FIG. 9 illustrates a space list.

In the present exemplary embodiment, a space list is further stored in the hard disk drive 102 (see FIG. 3).

In the space list, information on a location such as an address and position coordinates and information on a nearby station, a capacity, and sound insulation performance are registered for each of the spaces 2.

As the information on sound insulation performance, information indicative of a degree of sound insulation performance is registered, for example. Specifically, for example, any one of values 1 to 10 is registered.

In particular, in the present exemplary embodiment, a degree of sound insulation performance is rated on a 10-point scale, and any one of values 1 to 10 is registered as information indicative of a degree of sound insulation performance.

Figure 10:
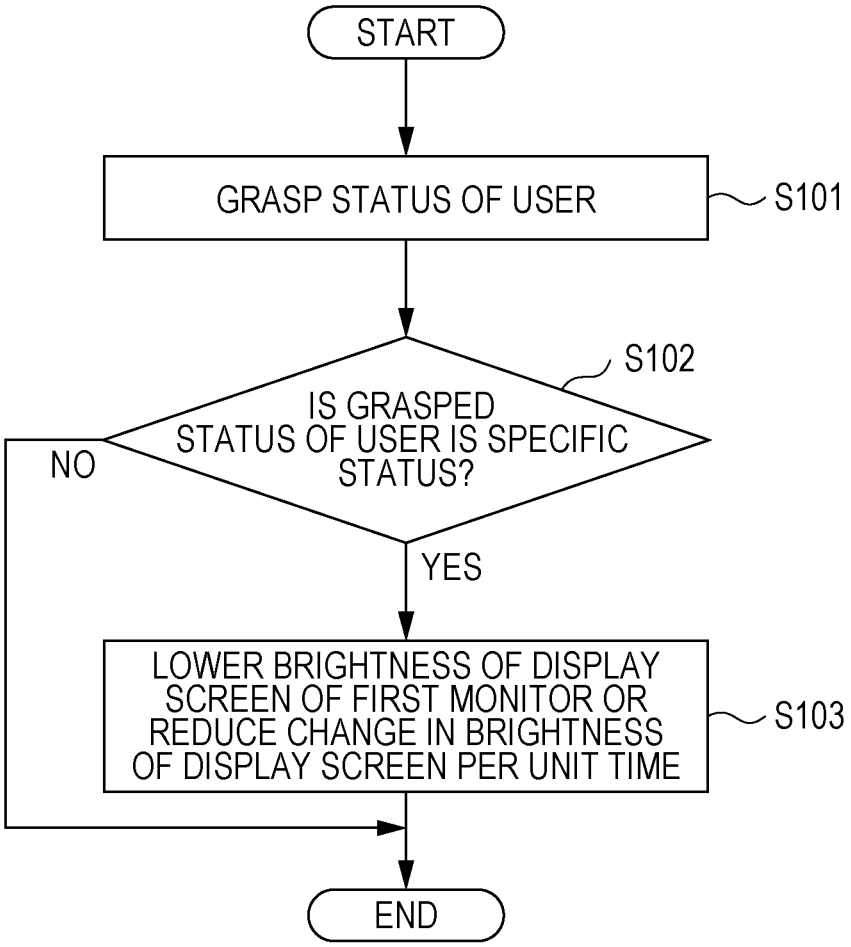
FIG. 10 is a flowchart illustrating an example of flow of processing executed by a CPU provided in the space management server.

FIG. 10 is a flowchart illustrating an example of flow of processing executed by the CPU 111, which is an example of a processor, provided in the space management server 5.

More specifically, FIG. 10 is a flowchart illustrating an example of flow of processing executed by the CPU 111 after a user enters a reserved space 2.

The CPU 111 according to the present exemplary embodiment grasps a status of a user who has entered a space 2.

In particular, in the present exemplary embodiment, when a user enters a space 2, this user is around the first monitor 31 (see FIG. 2), and the CPU 111 first grasps a status of this user who is around the first monitor 31 (step S101).

Next, the CPU 111 determines whether or not the grasped status of the user is a predetermined specific status (step S102).

Then, in a case where the grasped status of the user is the predetermined specific status, the CPU 111 lowers brightness of a display screen 31A (see FIG. 2) of the first monitor 31 or reduces a change in brightness of the display screen 31A per unit time (step S103).

The "lowering brightness of the display screen 31A" refers to reducing luminance of the display screen 31A.

The "luminance" of the display screen 31A can be obtained, for example, by placing an illuminance meter in front of the display screen 31A. In a case where a value obtained by the illuminance meter has become small, it can be said that the brightness of the display screen 31A has decreased.

Desirably, the lowered brightness is lower than the original brightness in all times after the lowering of the brightness. However, this configuration is not restrictive. The lowered brightness may temporarily become high and temporarily exceed the original brightness.

In particular, it can be said that the brightness of the display screen 31A has been lowered in a case where average brightness per unit time after the lowering of the brightness becomes smaller than average brightness per unit time before the lowering of the brightness.

The "average" is obtained by sequentially grasping the luminance of the display screen 31A at predetermined time intervals from the start to the end of a unit time to acquire plural luminance values and dividing a total sum of the plural luminance values by the total number of luminance values.

The "reducing a change in brightness of the display screen 31A per unit time" refers to reducing an error of mean square of luminance per unit time.

The "change in brightness of the display screen 31A per unit time" can be grasped, for example, by acquiring an error of mean square of plural luminance values obtained per unit time. It can be said that a change in brightness of the display screen 31A per unit time has been reduced in a case where this error of mean square has become small.

To acquire the error of mean square, first, plural luminance values are acquired by sequentially acquiring luminance of the display screen 31A at predetermined time intervals from the start to the end of a unit time. Then, an error of mean square is obtained from the plural luminance values.

To lower brightness of the display screen 31A of the first monitor 31, the CPU 111 turns off a light source 31B (see FIG. 11) provided in the first monitor 31 or lowers output of the light source 31B. This reduces brightness of the display screen 31A of the first monitor 31.

Alternatively, the CPU 111 reduces the brightness of the display screen 31A, for example, by changing content displayed on the display screen 31A of the first monitor 31.

Specifically, the CPU 111 reduces the brightness of the display screen 31A, for example, by changing content displayed on the display screen 31A to content containing a larger number of images of low brightness.

More specifically, the CPU 111 reduces the brightness of the display screen 31A, for example, by changing content displayed on the display screen 31A to darker content containing a larger number of black or dark blue images.

More specifically, in this case, the CPU 111 reduces the brightness of the display screen 31A by changing content displayed on the display screen 31A to content containing a larger number of images of low brightness and transmitting this content to the first monitor 31.

To reduce a change in brightness of the display screen 31A of the first monitor 31 per unit time, the CPU 111, for example, switches a target displayed on the display screen 31A from a moving image to a still image.

More specifically, in this case, the CPU 111 causes a still image to be displayed on the first monitor 31, for example, by pausing the moving image on the first monitor 31 or by transmitting not a moving image but a still image from the space management server 5 to the first monitor 31.

This reduces a change in brightness of the display screen 31A of the first monitor 31 per unit time.

Figure 11:
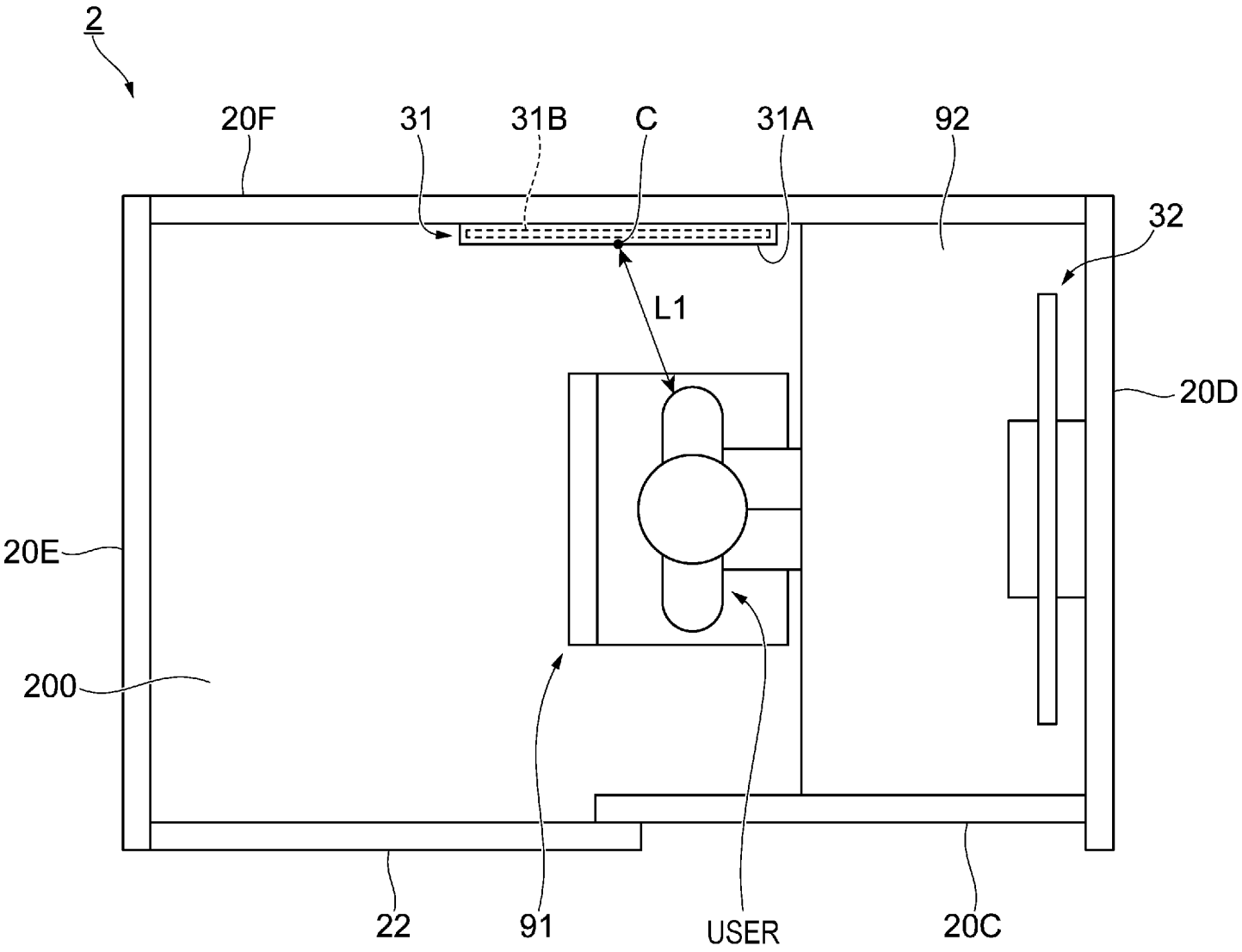
FIG. 11 illustrates a space viewed from above.

FIG. 11 illustrates a space 2 viewed from above. In FIG. 11, illustration of the ceiling 20A (see FIG. 2) is omitted. In FIG. 11, illustration of members such as the photographing device 24 (see FIG. 2) is also omitted.

In the present exemplary embodiment, the chair 91 and the desk 92 are provided in the space 2. It is assumed that a user works while sitting on the chair 91.

In this case, in the present exemplary embodiment, in a case where brightness of the display screen 31A of the first monitor 31 is lowered or in a case where a change in brightness of the display screen 31A of the first monitor 31 per unit time is reduced, the user can more concentrate on his or her work than a case where the brightness is not lowered or a case where the change in brightness per unit time is not reduced.

According to the configuration of the present exemplary embodiment, the first monitor 31 tends to be located beside the head of the user sitting on the chair 91. Accordingly, displaying an image on the first monitor 31 may undesirably hinder user's work.

In such a case, in a case where brightness of the display screen 31A of the first monitor 31 is lowered or a change in brightness of the display screen 31A of the first monitor 31 per unit time is reduced as in the present exemplary embodiment, the user can more concentrate on his or her work than a case where the brightness is not lowered or a case where the change in brightness per unit time is not reduced.

In the present exemplary embodiment, in a case where a grasped status of a user is a specific status, processing for lowering brightness of the display screen 31A or reducing a change in brightness of the display screen 31A per unit time is performed.

In addition to this processing, sound output in the space 2 may be lowered or stopped.

More specifically, sound output from the speaker 30A or the speaker of the first monitor 31 or the second monitor 32 may be lowered or stopped.

This allows the user to more concentrate on his or her work.

Next, conditions on which the brightness of the display screen 31A of the first monitor 31 is lowered or a change in brightness of the display screen 31A of the first monitor 31 per unit time is reduced are described.

In the present exemplary embodiment, in a case where a grasped status of a user is a specific status, the CPU 111 lowers the brightness of the display screen 31A of the first monitor 31 or reduces a change in brightness of the display screen 31A of the first monitor 31 per unit time, as described above.

More specifically, for example, in a case where a distance L1 between the first monitor 31 and the user becomes smaller than a predetermined distance, the CPU 111 lowers the brightness of the display screen 31A or reduces a change in brightness of the display screen 31A per unit time.

Hereinafter, the processing for lowering the brightness of the display screen 31A and the processing for reducing a change in brightness of the display screen 31A per unit time are referred to as "luminance adjustment processing".

More specifically, the CPU 111 performs the luminance adjustment processing, for example, in a case where the distance L1 between a center C in a width direction of the display screen 31A of the first monitor 31 and the user becomes smaller than a predetermined distance (e.g., 50 cm).

As the distance L1 between the first monitor 31 and the user becomes smaller, the user is influenced more by the first monitor 31. Performing the luminance adjustment processing in a case where the distance L1 between the first monitor 31 and the user is small reduces the influence on the user.

Alternatively, for example, the CPU 111 may perform the luminance adjustment processing in a case where the distance L1 between the first monitor 31 and the user is smaller than the predetermined distance continuously for more than a predetermined period.

This can prevent occurrence of a situation where the user is hard to concentrate on his or her work due to frequent occurrence of the luminance adjustment processing.

If the user frequently shifts his or her posture, the distance L1 between the first monitor 31 and the user may repeatedly become smaller and larger than the predetermined distance at short intervals.

As a result, the display screen 31A frequently switches between a bright state and a dark state, and the user is hard to concentrate on his or her work.

In the present exemplary embodiment, the luminance adjustment processing is performed in a case where the distance L1 between the first monitor 31 and the user is smaller than the predetermined distance continuously for more than the predetermined period. This can prevent the display screen 31A from frequently switching between a bright state and a dark state.

As a result, the situation where the user is hard to concentrate on his or her work due to frequent occurrence of the luminance adjustment processing is less likely to occur.

In a case where the distance L1 becomes larger than the predetermined distance, the CPU 111 performs processing (hereinafter referred to as "readjustment processing") for increasing the brightness of the display screen 31A or increasing a change in brightness of the display screen 31A per unit time.

In particular, the CPU 111 performs the readjustment processing in a case where the user moves away from the first monitor 31 and the distance L1 becomes larger than the predetermined distance after the distance L1 becomes small and the luminance adjustment processing is performed.

In particular, in a case where the user moves away from the first monitor 31 and the distance L1 becomes larger than the predetermined distance after the distance L1 becomes smaller than the predetermined distance and the luminance adjustment processing is performed, the CPU 111 returns the state of luminance of the display screen 31A of the first monitor 31 to that before the luminance adjustment processing.

The CPU 111 grasps the distance L1 between the first monitor 31 and the user, for example, by analyzing an image obtained by the photographing device 24 (see FIG. 2).

Alternatively, for example, the first monitor 31 may be provided with a human sensor that detects approach of a user to the first monitor 31.

In this case, the CPU 111 performs the luminance adjustment processing upon detection of the user by the human sensor and performs the readjustment processing when the human sensor ceases to detect the user.

Alternatively, the CPU 111 may perform the luminance adjustment processing in a case where the user takes a specific action around the first monitor 31.

More specifically, the CPU 111 may perform the luminance adjustment processing, for example, in a case where the user sits down on the chair 91 around the first monitor 31.

The CPU 111 determines whether or not the user has sat down on the chair, for example, by analyzing an image acquired by the photographing device 24.

Alternatively, the chair 91 may be provided with a sensor for detecting whether or not the user has sat down on the chair 91 and the CPU 111 may determine whether or not the user has sat down on the chair 91 based on output from this sensor.

Alternatively, the CPU 111 may perform the luminance adjustment processing in a case where the user starts specific work around the first monitor 31.

More specifically, the CPU 111 may perform the luminance adjustment processing, for example, in a case where the user starts spreading documents on the desk 92 provided in the space 2, a case where the user starts operating a personal computer (PC) (not illustrated) on the desk 92, or a case where the user starts operating a PC after connecting the PC to the second monitor 32.

The CPU 111 determines whether or not the user has started spreading documents on the desk 92 or whether or not the user has started operating a PC on the desk 92, for example, by analyzing an image acquired by the photographing device 24.

The CPU 111 determines whether or not the user has started operating a PC after connecting the PC to the second monitor 32, for example, based on output from the second monitor 32.

Alternatively, the CPU 111 may perform the luminance adjustment processing in a case where the user around the first monitor 31 (the user in the space 2) turns away from the display screen 31A of the first monitor 31.

In a case where this processing is performed, the brightness of the display screen 31A of the first monitor 31 is kept high or a change in brightness of the display screen 31A per unit time is kept large until the user who has entered the space 2 sees the first monitor 31.

Furthermore, even after the user sees the display screen 31A, the brightness of the display screen 31A of the first monitor 31 is kept high or a change in brightness of the display screen 31A per unit time is kept large until the user turns away from the display screen 31A.

Then, the CPU 111 performs the luminance adjustment processing in a case where the user turns away from the display screen 31A.

It can be assumed that in a case where the user turns away from the display screen 31A, the user is about to start work such as operating a PC.

In this case, performing the luminance adjustment processing allows the user to more concentrate on the work.

The CPU 111 determines whether or not the user has turned away from the display screen 31A, for example, by analyzing an image obtained by the photographing device 24. More specifically, the CPU 111 determines that the user has turned away from the display screen 31A in a case where the display screen 31A is no longer present on a line of sight of the user in the image obtained by the photographing device 24. In this case, the CPU 111 performs the luminance adjustment processing.

Next, the readjustment processing is described.

The CPU 111 performs the readjustment processing in a case where a predetermined specific condition is met after the luminance adjustment processing is performed.

The CPU 111 performs, as the readjustment processing, processing for increasing the brightness of the display screen 31A of the first monitor 31 or increasing a change in brightness of the display screen 31A per unit time.

This returns the state of luminance of the display screen 31A to that before the luminance adjustment processing.

More specifically, the CPU 111 increases the brightness of the display screen 31A of the first monitor 31 or increases a change in brightness of the display screen 31A of the first monitor 31 per unit time by performing processing opposite to the luminance adjustment processing.

Specifically, the CPU 111 increases the brightness of the display screen 31A of the first monitor 31, for example, by turning on the light source 31B of the first monitor 31 or by increasing output of the light source 31B of the first monitor 31.

Alternatively, the CPU 111 increases the brightness of the first monitor 31, for example, by changing content displayed on the display screen 31A of the first monitor 31.

Specifically, the CPU 111 increases the brightness of the display screen 31A by changing the content displayed on the display screen 31A to content containing a larger number of images of high brightness.

The CPU 111 increases a change in brightness of the display screen 31A per unit time, for example, by switching a target displayed on the display screen 31A from a still image to a moving image.

By thus returning the state of brightness of the display screen 31A to that before the luminance adjustment processing, the display screen 31A of the first monitor 31 is made more noticeable. This makes advertisement for the user more effective.

In other words, information is more effectively transmitted to the user.

In the present exemplary embodiment, the CPU 111 performs the readjustment processing in a case where a predetermined specific condition is met. More specifically, the CPU 111 performs the readjustment processing, for example, in a case where the user takes a specific action.

In particular, the CPU 111 lowers the brightness of the display screen 31A or reduces a change in brightness of the display screen 31A per unit time by performing the luminance adjustment processing as described above, but in a case where the user takes a specific action after this processing, the CPU 111 returns the state of brightness to the original state by performing the readjustment processing.

More specifically, the CPU 111 increases the brightness of the display screen 31A or increases a change in brightness of the display screen 31A per unit time, for example, in a case where the user touches the display screen 31A of the first monitor 31.

More specifically, in a case where this processing is performed, a touch panel is employed as the first monitor 31. In this case, the CPU 111 performs the readjustment processing in a case where the user touches the display screen 31A of the first monitor 31 and a signal indicating that user touched the display screen 31A is transmitted from the first monitor 31.

It can be assumed that in a case where the user touches the first monitor 31, the user is interested in content displayed on the first monitor 31.

In this case, in a case where the brightness of the display screen 31A or a change in brightness of the display screen 31A per unit time is returned to the original state by the readjustment processing, information can be more effectively transmitted to the user.

Alternatively, the CPU 111 may perform the readjustment processing in a case where the user exits the space 2.

In particular, the space 2 according to the present exemplary embodiment is surrounded by the wall 20C (see FIG. 11), the door 22, the wall 20D, the wall 20E, and the wall 20F to create the room 200, and the CPU 111 may performs the readjustment processing in a case where the user exits the room 200.

The CPU 111 determines whether or not the user has exited the room 200 (space 2), for example, by analyzing an image obtained by the photographing device 24 (see FIG. 2). The CPU 111 determines that the user has exited the room 200 in a case where the user disappears from the room 200.

Alternatively, for example, the CPU 111 may determine that the user has exited the room 200 upon detection of opening of the door 22 by the opening closing sensor S1 (see FIG. 2) that detects opening and closing of the door 22.

In the present exemplary embodiment, in a case where the CPU 111 determines that the user has exited the room 200, the CPU 111 returns the state of luminance of the display screen 31A to that before the luminance adjustment processing by performing the readjustment processing.

With this configuration, in a case where a new user arrives at the room 200 later, this new user can be greeted in a state where the brightness of the display screen 31A is high or a state where a change in brightness of the display screen 31A per unit time is large.

Alternatively, for example, the CPU 111 may perform the readjustment processing, for example, in a case where the user stands up from the chair 91 placed in the space 2.

It can be assumed that in a case where the user stands up from the chair 91, the user has finished work on the desk 92. In this case, influence on the user is small even in a case where the brightness of the display screen 31A is increased or a change in brightness of the display screen 31A per unit time is increased.

The CPU 111 determines whether or not the user has stood up from the chair 91, for example, by analyzing an image obtained by the photographing device 24.

Alternatively, the chair 91 may be provided with a sensor for detecting whether or not a user has stood up, and the CPU 111 may determine whether or not the user has stood up from the chair 91 on the basis of output from this sensor.

Alternatively, the CPU 111 may determine whether or not the user has moved the chair 91 back by analyzing an image obtained by the photographing device 24. In this case, the CPU 111 may determine that the user has stood up from the chair 91 in a case where the user moves the chair 91 back.

Alternatively, the readjustment processing may be performed in a case where the user sees the display screen 31A of the first monitor 31.

The CPU 111 determines whether or not the user has seen the display screen 31A of the first monitor 31, for example, by analyzing an image obtained by the photographing device 24.

More specifically, the CPU 111 determines that the user has seen the display screen 31A of the first monitor 31 in a case where the first monitor 31 is present on a line of sight of the user.

In this case, the CPU 111 increases the brightness of the display screen 31A or increases a change in brightness of the display screen 31A per unit time.

Although the readjustment processing may be performed as soon as the user sees the display screen 31A of the first monitor 31, the readjustment processing may be performed, for example, in a case where the user continues to see the display screen 31A of the first monitor 31 for more than a predetermined period.

This prevents the state of luminance of the display screen 31A from being frequently changed.

Other Remarks

Although the luminance adjustment processing and the readjustment processing are performed on the first monitor 31, the luminance adjustment processing and the readjustment processing may also be performed on the second monitor 32.

In particular, the second monitor 32 may also be used as digital signage. In this case, the luminance adjustment processing and the readjustment processing may also be performed on the second monitor 32 in a similar manner.

In the above example, the luminance adjustment processing and the readjustment processing are performed on the first monitor 31 located beside a head of a user sitting on the chair 91.

This configuration is not restrictive. The luminance adjustment processing and the readjustment processing may also be performed on the second monitor 32 located in front of the sitting user.

In the above example, the luminance adjustment processing and the readjustment processing are performed on a monitor (the first monitor 31) placed in the space 2 (room 200).

This configuration is not restrictive. The luminance adjustment processing and the readjustment processing may also be performed on a monitor provided outside the room 200.

Specifically, for example, the luminance adjustment processing and the readjustment processing may also be performed on a monitor placed in a public place such as a train station in a similar manner when a specific condition is met.

Alternatively, the luminance adjustment processing and the readjustment processing may be performed on the basis of an ambient environment of the first monitor 31 (on the basis of an environment in the space 2 (room 200)).

Specifically, for example, the brightness of the display screen 31A may be lowered or a change in brightness of the display screen 31A per unit time may be reduced by performing the luminance adjustment processing in a case where an environment around the first monitor 31 is dark, specifically, in a case where illuminance around the first monitor 31 is smaller than predetermined illuminance.

Furthermore, for example, the brightness of the display screen 31A may be increased or a change in brightness of the display screen 31A per unit time may be increased by performing the readjustment processing in a case where the environment around the first monitor 31 shifts from a dark state to a bright state and the illuminance around the first monitor 31 becomes larger than the predetermined illuminance.

In the embodiment above, the term "processor" refers to hardware in a broad sense. Examples of the processor includes general processors (e.g., CPU: Central Processing Unit), dedicated processors (e.g., GPU: Graphics Processing Unit, ASIC: Application Integrated Circuit, FPGA: Field Programmable Gate Array, and programmable logic device).

In the embodiment above, the term "processor" is broad enough to encompass one processor or plural processors in collaboration which are located physically apart from each other but may work cooperatively. The order of operations of the processor is not limited to one described in the embodiment above, and may be changed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A control device comprising a processor configured to:

grasp a status of a user around a display device;

lower brightness of a display screen of the display device or reduce a change in brightness of the display screen per unit time in a case where the grasped status of the user is a specific status; and increase the brightness of the display screen or increase the change in brightness of the display screen per unit time in a case where the user takes a specific action after the processor lowers the brightness of the display screen or reduces the change in brightness of the display screen per unit time; wherein the specific action includes a case where the user stands up from a chair placed around the display device.

2. The control device according to claim 1, wherein the processor lowers the brightness of the display screen or reduces the change in brightness of the display screen per unit time in a case where the user takes another specific action around the display device.

3. The control device according to claim 2, wherein the processor lowers the brightness of the display screen or reduces the change in brightness of the display screen per unit time in a case where the user sits down on a chair around the display device.

4. The control device according to claim 2, wherein the processor lowers the brightness of the display screen or reduces the change in brightness of the display screen per unit time in a case where a user starts specific work around the display device.

5. The control device according to claim 2, wherein the processor lowers the brightness of the display screen or reduces the change in brightness of the display screen per unit time in a case where the user around the display device turns away from the display screen.

6. The control device according to claim 1, wherein the processor lowers the brightness of the display screen or reduces the change in brightness of the display screen per unit time in a case where a distance between the display device and the user becomes smaller than a predetermined distance.

7. The control device according to claim 6, wherein the processor lowers the brightness of the display screen or reduces the change in brightness of the display screen per unit time in a case where the distance between the display device and the user is smaller than the predetermined distance continuously for more than a predetermined period.

8. The control device according to claim 6, wherein the processor increases the brightness of the display screen or increases the change in brightness of the display screen per unit time in a case where the distance between the display device and the user becomes larger than the predetermined distance.

9. The control device according to claim 1, wherein the processor lowers the brightness of the display screen by changing content displayed on the display screen of the display device.

10. The control device according to claim 9, wherein the processor lowers the brightness of the display screen by changing content displayed on the display screen to content containing a larger number of images of low brightness.

11. The control device according to claim 1, wherein the processor lowers the brightness of the display screen by turning off a light source provided in the display device or lowering output of the light source.

12. The control device according to claim 1, wherein the processor reduces the change in brightness of the display screen per unit time by switching a target displayed on the display screen from a moving image to a still image.

13. The control device according to claim 1, wherein the specific action includes a case where the user touches the display device.

14. The control device according to claim 1, wherein the specific action includes a case where the user exits a room in which the display device is provided.

15. The control device according to claim 1, wherein the specific action includes a case where the user faces the display screen.

16. A non-transitory computer readable medium storing a program causing a computer to execute a process comprising:

grasping a status of a user around a display device, lowering brightness of a display screen of the display device or reducing a change in brightness of the display screen per unit time in a case where the grasped status of the user is a specific status; and increasing the brightness of the display screen or increasing the change in brightness of the display screen per unit time in a case where the user takes a specific action after the lowering the brightness of the display screen or reducing the change in brightness of the display screen per unit time; wherein the specific action includes a case where the user stands up from a chair placed around the display device.

17. A control device comprising:

means for grasping a status of a user around a display device, means for lowering brightness of a display screen of the display device or reducing a change in brightness of the display screen per unit time in a case where the grasped status of the user is a specific status; and means for increasing the brightness of the display screen or increasing the change in brightness of the display screen per unit time in a case where the user takes a specific action after the lowering the brightness of the display screen or reducing the change in brightness of the display screen per unit time; wherein the specific action includes a case where the user stands up from a chair placed around the display device.

* * * * *